US005728982A

United States Patent [19]

Rao et al.

[11] Patent Number: 5,728,982

[45] Date of Patent: Mar. 17, 1998

[54] MINIATURE ROTARY ELECTRIC SWITCH

[75] Inventors: Chepur P. Rao, Kingstown; Bryan A. Thurston, Johnston; Robert J. Carreiro, East Providence, all of R.I.

[73] Assignee: Tower Manufacturing Corporation

[21] Appl. No.: 593,647

[22] Filed: Jan. 29, 1996

[51] Int. Cl.[6] ..... H01H 21/18; H01H 1/12; H01H 9/28; H01H 19/58

[52] U.S. Cl. ..... 200/6 R; 200/11 R; 200/11 G; 200/6 C; 200/6 BB; 200/303; 200/284

[58] Field of Search ..... 200/6 R, 6 A, 200/6 B, 6 C, 11 R, 284, 11 G, 283, 303, 6 BB, 11 C

[56] References Cited

U.S. PATENT DOCUMENTS

| | | | |
|---|---|---|---|
| 1,653,354 | 12/1927 | Ferguson . | |
| 2,059,712 | 11/1936 | Schellenger . | |
| 2,315,262 | 3/1943 | Lefebre . | |
| 2,723,327 | 11/1955 | Gilbert | 200/168 |
| 2,813,158 | 11/1957 | Hutt | 200/6 |
| 2,833,874 | 5/1958 | Stolle . | |
| 2,939,337 | 6/1960 | Sweger . | |
| 3,637,967 | 1/1972 | Braun . | |
| 3,748,419 | 7/1973 | Torrey et al. . | |
| 3,780,245 | 12/1973 | Beddow . | |
| 3,971,904 | 7/1976 | Ward . | |
| 4,114,002 | 9/1978 | Hochgesang . | |
| 4,163,879 | 8/1979 | Mayer et al. . | |
| 4,191,867 | 3/1980 | Feaster . | |
| 4,243,853 | 1/1981 | Turner . | |
| 4,495,387 | 1/1985 | Thrush . | |

*Primary Examiner*—Peter S. Wong
*Assistant Examiner*—Rajnikant B. Patel
*Attorney, Agent, or Firm*—Kriegsman & Kriegsman

[57] ABSTRACT

A miniature rotary electric switch having push-in wire terminals comprises a housing which is about 1 inch in length, 1 inch in width and 0.2 inches in thickness and which includes a plurality of wire receiving openings. A plurality of Z-shaped stationary contacts are positioned inside the housing and a rotatable contactor is disposed inside the housing for selectively contacting the stationary contacts. Each stationary contact is positioned to overlie at least a portion of one of the wire receiving openings for locking engagement with a wire to be inserted therethrough. Each stationary contact includes a locking tongue, a spring finger and an intermediate arm, the intermediate arm linking the locking tongue to the spring finger. The locking tongue is connected to the intermediate arm at a first bend and the intermediate arm is connected to the spring finger at a second bend. The housing of the switch is configured to include a plurality of pairs of corners and a plurality of posts, one post being adjacent but spaced away from each corner. Each stationary contact is disposed in the housing with its first bend wedged in one corner in a pair of corners and extending around the post adjacent that corner and its second bend wedged in the other corner in the pair of corners and extending around its post adjacent that corner. Each stationary contact further includes a third bend in the intermediate arm, the third bend having an angle of about 130 degrees to about 140 degrees. The spring finger of each stationary contact comprises a straight member and a bent tip, the straight member and the bent tip forming a bend angle at the junction thereof of about 80 degrees.

22 Claims, 5 Drawing Sheets

MINIATURE ROTARY ELECTRIC SWITCH

BACKGROUND OF THE INVENTION

The present invention relates generally to electric switches and, more particularly, to rotary electric switches with push-in wire terminals.

Rotary electric switches with push-in wire terminals, sometimes referred to as "quick connect" terminals, are known in the art and are widely used to control alternating current circuits for such applications as the speed control of fan motors.

One well-known rotary electric switch with push-in wire terminals includes a hollow rectangularly shaped housing having a length of about 1.25 inches, a width of about 1.25 inches, and a thickness of about 0.40 inches. The housing is made of plastic and includes a recessed base and a cover member. A rotatable contactor is centered in the base and is controlled by a shaft coupled to the rotatable contactor. A set of four resilient stationary contacts are positioned edgewise in the base around the rotatable contactor for making and breaking the several circuits through the switch.

Each stationary contact is generally in the shape of a Z, where the ends of the Z represent a locking tongue and a spring contact finger which are joined together by an intermediate arm. There are generally two principal bends in the Z shaped stationary contact, a first bend being formed where the locking tonic is connected to the intermediate arm and a second bend being formed where the intermediate arm is connected to the spring contact finger, the two bends being wedged in corners formed in the base. A third bend is also formed in the stationary contact, the third bend being situated proximate the midpoint of the intermediate arm. The third bend has an angle of about 150 degrees, the angle being measured on the side of the intermediate arm closest to the spring contact finger. The three aforementioned bends in the stationary contact all serve the function of enabling the intermediate arm to flex slightly so as to distribute the bending stresses exerted on both the locking tongue and the spring finger when in use.

The spring finger on the stationary contact comprises a straight member having a bent tip at its free end. It is the bent tip of each spring finger which engages with the contact surfaces of the rotatable contactor to close the variable circuits through the switch.

The locking tongue on the stationary contact provides the switch with the capability of implementing the push-in wire terminals. In particular, a wire to be connected to the switch is pushed through a wire receiving opening formed in the base, the wire receiving opening being partially covered by the free end of the locking tongue of the stationary contact. Once forced through the wire receiving opening, the wire will displace the locking tongue away from the opening which enables the wire to be fed into the base. Once the wire is sufficiently pushed through the opening, the locking tongue engages the side of the wire and effectively locks the wire within the switch between the stationary contact and a sidewall of the housing. When a pulling force is exerted to remove the wire from the switch, the wire tends to carry the tongue with it so that the locking tongue is pushed harder against the wire wedging it against the side wall of the plastic housing, the force of the wedging pressure increasing in proportion to the pulling force exerted on the wire. Therefore, the locking tongue serves two purposes; namely, to lock the circuit wire into the switch, and also to provide a means for connecting the circuit wire to the switch.

The housing in the above described type of switch is also configured to include four posts, one post being located so as to be within the first bend of each stationary contact. These posts ensure that the first bend of each stationary contact is held in place in the housing so as to enable for the proper insertion capability of a wire past the locking tongue of each contact in the switch.

Examples of rotary electric switches with push-in wire terminals may be found in U.S. Pat. No. 2,813,158 to P. Hutt and U.S. Pat. No. 3,748,419 to D. Torrey et al, both of which are incorporated herein by reference.

In U.S. Pat. No. 2,813,158 to P. Hutt there is disclosed an electric switch comprising a hollow housing with a recessed base and a cover member held therewith, at least three resilient contacts positioned in the base, each contact being of generally Z-shape and comprising a locking tongue at its terminal end, an intermediate arm, and a spring finger, a rotatable contactor mounted in the base between the spring fingers of the contacts, and shaft means for moving the contactor, the said contactor having detent notches in its periphery so that the spring fingers which are not connected in a complete circuit through the switch serve as an indexing means in cooperation with the said detent notches, the locking tongue of each contact being positioned adjacent an outer wall of the base with its free end overlying a conductor wire-receiving opening in the wall, one edge of said opening being aligned with an adjacent wall of the switch base, and a partition extending from the said outer wall substantially parallel with the adjacent wall to form a corner, one bend in the Z-shaped contact being positioned in said corner while the other bend in the contact is seated in an opposite corner in the base formed by said adjacent wall and a cooperating partition, whereby a bare wire may be inserted through the opening in the base to move the locking tongue aside until the tongue engages the side of the wire, any pulling force exerted on the wire tending to drag the locking tongue into a tighter wedging engagement with the wire to increase its holding power.

In U.S. Pat. No. 3,748,419 to D. Torrey et al there is disclosed a rotary switch comprising a housing having a plurality of wire receiving apertures. A rotatable contactor having a peripheral edge of preselected configuration is mounted within the housing for rotation about an axis. A plurality of mutually spaced contacts is positioned within the housing radially about the axis for contact with portions of the contactor peripheral edge in rotatably selected contactor positions. A feeder contact is also positioned within the housing. The feeder contact has an annular portion positioned in pressure contact with the contactor in all rotatably selectable contactor positions, a pressure locking tongue portion overlaying at least a portion of one of the wire receiving apertures in the housing for locking engagement with a wire inserted through the one wire receiving aperture, and a linking portion electrically and mechanically linking the annular portion with the pressure locking tongue portion.

Recently, it has been suggested that rotary electric switches with push-in terminals be made smaller in size. However, it has been found that when the overall size of the housing and the components inside the housing are made smaller, the resulting switch does not perform satisfactorily. In particular, the stationary contacts have a tendency to move about more within the housing. Also, the rotational feel and wire insertion capability is not the same as in past switches of this type.

SUMMARY OF THE INVENTION

It is an object of the present invention to provide a new and improved rotary electric switch.

It is another object of the present invention to provide a rotary electric switch having push-in wire type terminals.

It is yet another object of the present invention to provide a rotary electric switch as described above which is smaller in size than switches of this type made in the past.

It is still another object of the present invention to provide a rotary electric switch as described above in which each wire that is inserted into the switch makes a satisfactory connection with its associated stationary contact.

It is a further object of the present invention to provide a rotary electric switch as described above in which the spring finger of each stationary contact is properly positioned to make a satisfactory connection with the rotatable contact.

It is yet another object of the present invention to provide a rotary electric switch as described above which has the same wire insertion capability as a switch of this type made in the past.

It is still another objection of the present invention to provide a rotary electric switch as described above in which the shaft and the rotatable contact have the same angular rotational feel within the housing as in a switch of this type made in the past.

It is yet still another object of the present invention to provide a rotary electric switch as described above which can be mass produced and can be very easily and satisfactorily used.

Accordingly, there is provided a rotary electric switch comprising a housing having a plurality of wire receiving openings, a plurality of stationary contacts positioned within said housing, and a rotatable contactor mounted inside said housing, the rotatable contactor selectively contacting said stationary contacts, each stationary contact being generally Z shaped and comprising a locking tongue, a spring finger and an intermediate arm, the intermediate arm linking the locking tongue to the spring finger, the locking tongue being connected to the intermediate arm at a first bend and the intermediate arm being connected to the spring finger at a second bend, each stationary contact being positioned in said housing so that its locking tongue overlies at least a portion of one of said wire receiving openings for locking engagement with a wire to be inserted therethrough, said housing being configured to include a plurality of posts, two for each stationary contact, to assist in holding the stationary contacts in place in the housing.

According to another feature of the invention, each stationary contact further includes a third bend, the third bend being in the intermediate arm and having an angle of about 130 degrees to 140 degrees.

According to yet another feature of the invention, the spring finger of each stationary contact comprises a straight member and a bent tip, the straight member and the bent tip forming a bend angle at the junction thereof of about 80 degrees.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Figure 1:
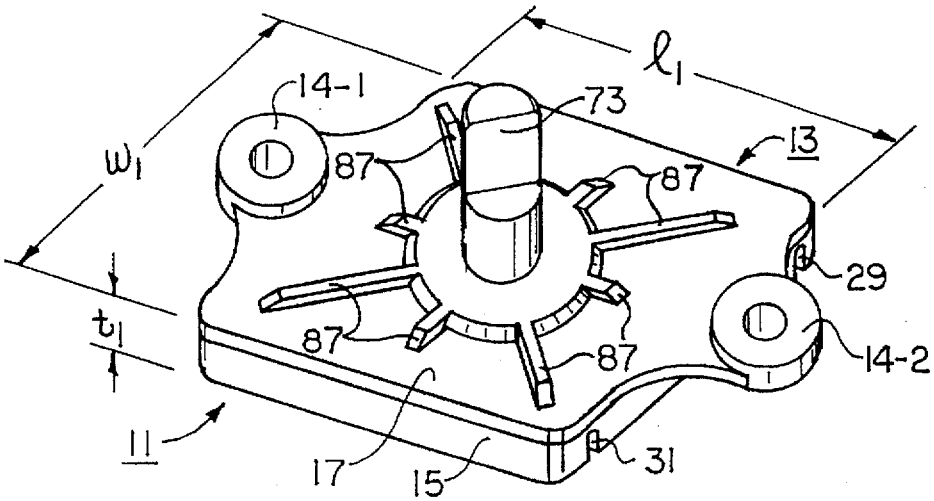
FIG. 1 is a perspective view taken from the top of a rotary electric switch constructed according to this invention.
Figure 3:
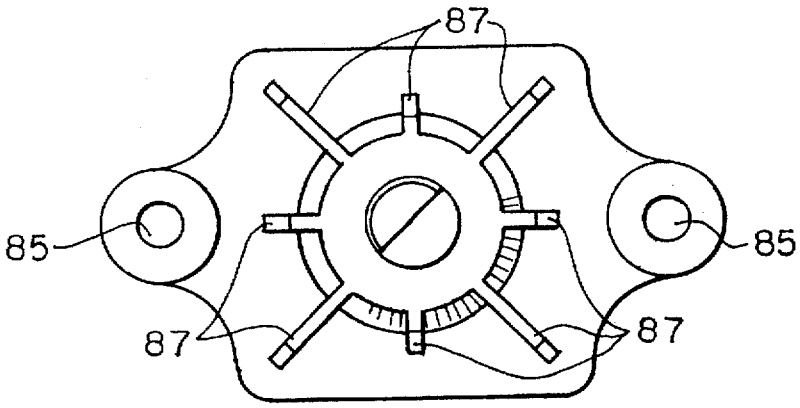
FIG. 3 is a top plan view of the rotary electric switch shown in FIG. 1.
Figure 4:
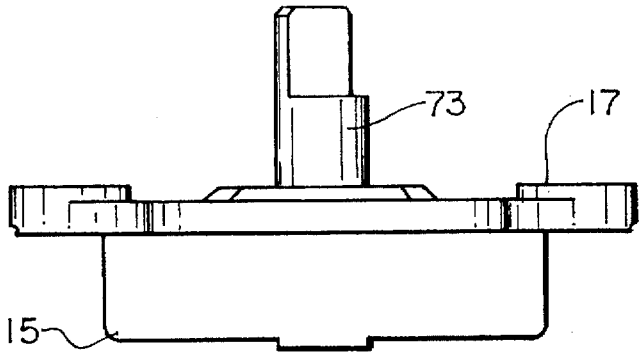
FIG. 4 is a front elevational view of the rotary electric switch shown in FIG. 1.

Referring now to the drawings, there is shown in FIGS. 1–4 a rotary electric switch with push-in wire terminals constructed according to the teachings of the present invention, the rotary electric switch being represented generally by reference numeral 11. Portions of switch 11 are also shown in FIGS. 5–8.

Switch 11 comprises a generally rectangularly shaped hollow housing 13 constructed of plastic or other suitable insulating material. Housing 13 includes a recessed base 15 and a cover member 17; recessed base 15 and cover member 17 being fixedly attached together, such as by ultrasonic welding.

Housing 13 has a length $l_1$ of about 1.0 inches excluding bosses 14-1 and 14-2, a width $w_1$ of about 1.0 inches and a thickness $t_1$ of about 0.2 inches. Recessed base 15 includes a bottom wall 19 and four sidewalls 21, 23, 25 and 27, the sidewalls being angled so as to form four fight angle corners 28-1 through 28-4. Sidewall 21 includes a pair of conductor wire-receiving openings 29 and 31 and sidewall 25, which is opposite sidewall 21, includes a pair of conductor wire receiving openings 33 and 35. Base 15 also includes a pair of first partitions 37-1 and 37-2. First partition 37-1 extends inwardly at a right angle from sidewall 21 to form a pair of corners 39-1 and 39-2, one on each side of partition 37-1. In a similar manner, first partition 37-2 extends inwardly at a right angle from sidewall 25 to form a pair of corners 39-3 and 39-4, one on each side of partition 37-2. Base 15 further includes a pair of second partitions 41-1 and 41-2. Second partition 41-1 extends inwardly at a right angle from sidewall 23 to form a pair of corners 43-1 and 43-2, one on each side of partition 41-1. In a similar manner, second partition 41-2 extends inwardly at a right angle from sidewall 27 to form a pair of corners 43-3 and 43-4, one on each side of partition 41-2. Thus, partitions 37-1, 37-2, 41-1 and 41-2 along with sidewalls 21, 23, 25 and 27 create four pairs of corners, one pair comprising corners 39-1 and 43-3, another pair comprising corners 39-3 and 43-4, the third pair comprising corners 39-4 and 43-2 and the fourth pair comprising corners 39-2 and 43-1. Also, corners 28-1, 39-1 and 43-3 collectively form a first pocket 45-1 on base 15, corners 28-2, 39-3 and 43-4 collectively form a second pocket 45-2, corners 28-3, 39-4 and 43-2 collectively form a third pocket 45-3 and corners 28-4, 39-2, and 43-1 collectively form a fourth pocket 45-4.

Switch 11 further comprises four resilient stationary contacts 47-1 through 47-4, which are positioned in pockets 45-1 through 45-4, respectively (which will be discussed in greater detail below).

Figure 7:
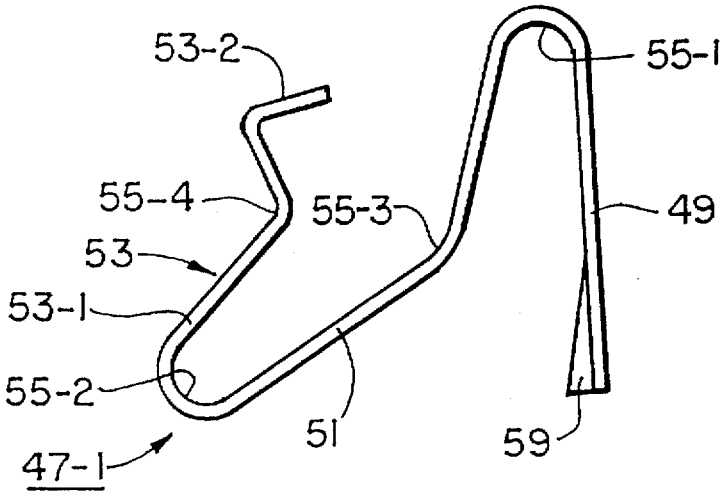
FIG. 7 is a top plan view of one of the stationary contacts shown in FIG. 6.
Figure 8:
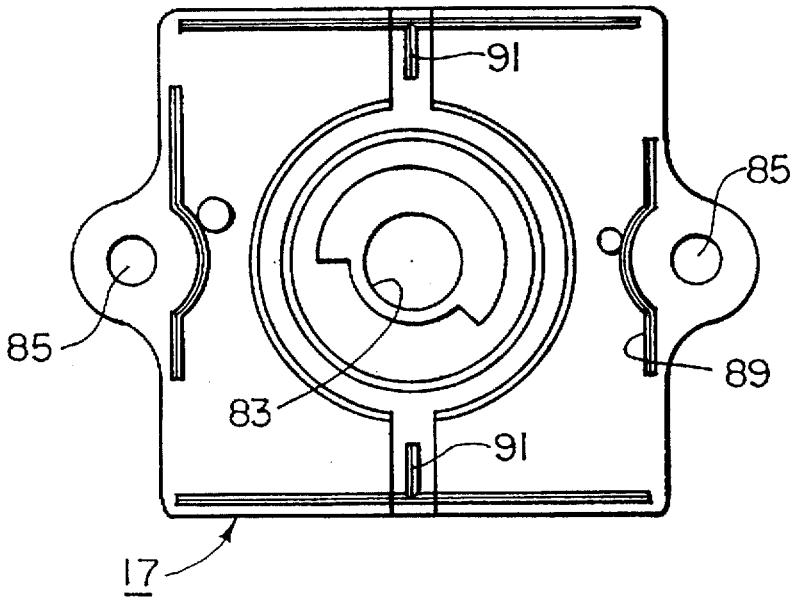
FIG. 8 is a bottom plan view of the cover shown in FIG. 2.

Referring now to FIG. 7, there is shown a top view of a resilient stationary contact 47-1. Resilient stationary contact 47-1 is generally Z-shaped and is constructed preferably of bronze. Contact 47-1 comprises a locking tongue 49, an intermediate arm 51, and a spring finger 53; intermediate arm 51, locking tongue 49 and spring finger 53 comprising a unitary structure. Locking tongue 49 is connected to intermediate arm 51 at a first bend 55-1, and intermediate arm 51 is connected to spring finger 53 at a second bend 55-2. Contacts 47-2 through 47-4 are identical to contact 47-1.

Figure 6:
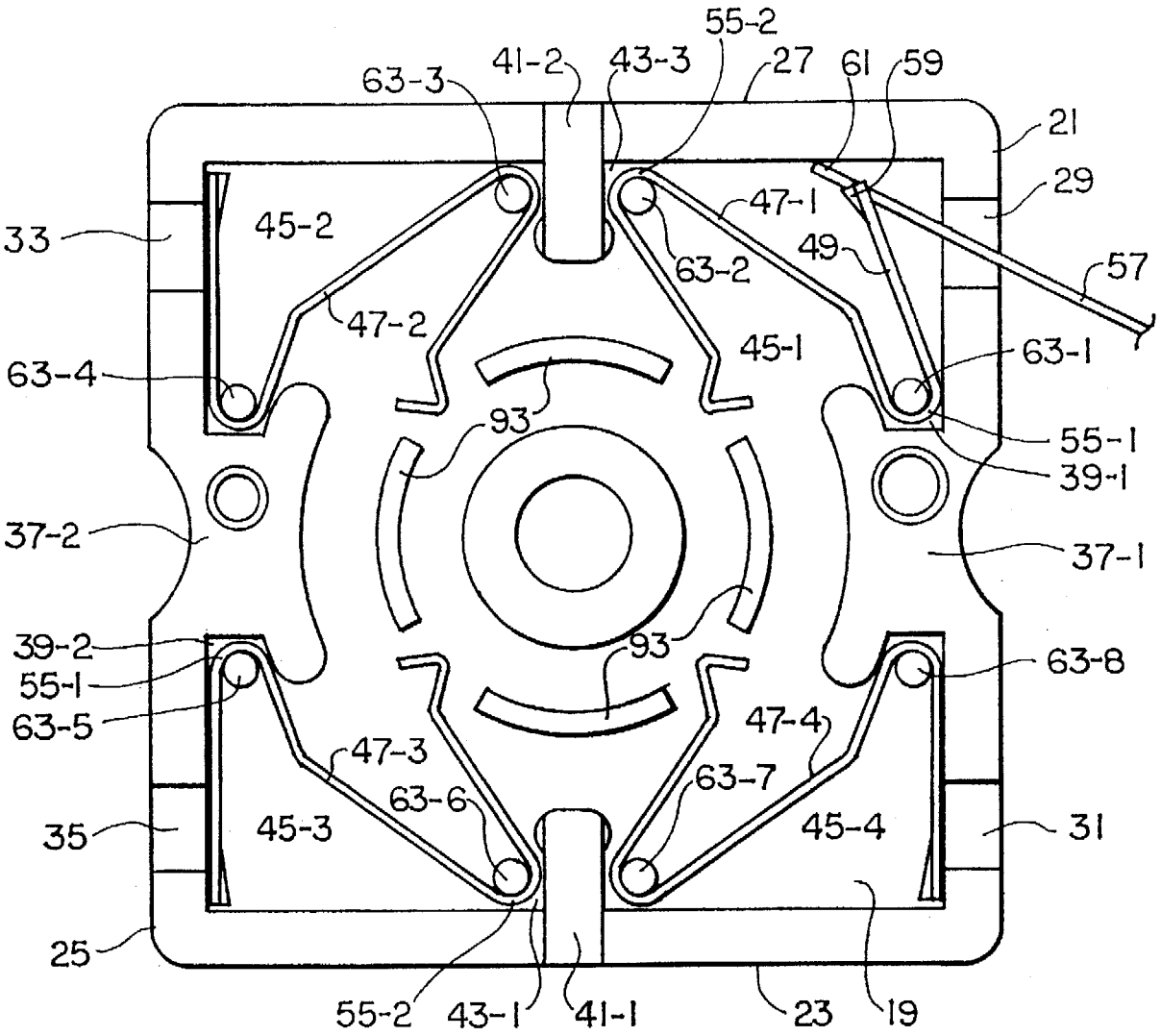
FIG. 6 is an enlarged top plan view of the base shown in FIG. 2 with the stationary contacts positioned within the base and a wire inserted into one of the openings.

As shown in FIG. 6, contact 47-1 is positioned in pocket 45-1, such that first bend 55-1 is positioned in corner 39-1 and second bend 55-2 is positioned in corner 43-3. When cover 17 is on base 15, partitions 37-1 and 41-2 serve to loosely hold contact 47-1 in place in corners 39-1 and 43-3. In addition, partitions 37-1 and 41-2 also serve to adequately space apart contacts 47 to prevent arcing. Contacts 47-2 through 47-4 are seated in corners 45-2 through 45-4, respectively, in a similar manner.

As can be further seen in FIG. 6, contact 47-1 is positioned in corner 45-1 such that locking tongue 49 overlies at least a portion of conductor wire-receiving opening 29, locking tongue 49 being positioned for locking engagement with a wire 57 which is inserted therethrough. Locking tongue 49 includes a V-shaped groove 59 at its free end, groove 59 facing outwardly towards opening 29.

In use, a wire 57 having a tip 61 is to coupled to contact 47-1 by inserting wire 57 through conductor wire-receiving opening 29. As can be seen, inserting wire 57 through opening 29 pivots locking tongue 49 inward about first bend 55-1, thereby enabling wire 57 to be advanced through opening 29 with V-shaped groove 59 of locking tongue 49 engaging the side of wire 57. V-shaped groove 59 serves as a guide means tending to hold wire 57 on the center line of locking tongue 49 during insertion. V-shaped groove 59 also acts as a point of contact between wire 57 and contact 47-1, which enables wire 57 of the circuit to be connected to regulating switch 11. When fully inserted through opening 29, wire 57 will be wedged between V-shaped groove 57 and sidewall 27.

With wire 57 inserted, any pulling force exerted to remove wire 57 out from switch 11 will cause locking tongue 49 to drag towards opening 29, thereby wedging wire 57 between locking tongue 49 and sidewall 27. This wedging action locks wire 57 within switch 11 and prevents its removal. Wires (not shown) are inserted into the other wire receiving openings 31, 33 and 35 in a similar manner.

Base 15 is further configured to include eight posts 63-1 through 63-8. These posts are integrally formed projections which extend up orthogonally from bottom wall 19 and serve to assist in maintaining the stationary contacts wedged in their respective corners in base 19 and preventing any shifting movement during use. Alternatively, posts 63 could be formed on cover 17 instead of base 15.

Post 63-1 is located proximate corner 39-1 but spaced away from corner 39-1 and post 63-2 is located proximate corner 43-3 but spaced away from corner 43-3. Thus, one post 63-1 is located in pocket 45-1 so that bend 55-1 of contact 47-1 is sandwiched between corner 39-1 and post 63-1, and post 63-2 is located in pocket 45-1 so that bend 55-2 is sandwiched between corner 43-3 and post 63-2.

Posts 63-3 through 63-8 are located and function in a similar manner with respect to contacts 47-2 through 47-4.

Contact 47-1 further includes a third bend 55-3 located proximate the midpoint of intermediate arm 51. Third bend 55-3, measured on the side of arm 51 closest to spring finger 53, has an angle from approximately 130 degrees to approximately 140 degrees. Third bend 55-3 absorbs some of the stress imposed on contact 47-1 in use, the stress often causing contact 47-1 to shift. Third bend 55-3 also serves to create the same angular rotational feel of the rotatable contact (to be hereinafter described in detail) as well as the wire insertion capability as in conventional full size switches.

Finally, spring finger 53 of contact 47-1 comprises an elongated straight member 53-1 and bent tip 53-2. Elongated member 53-1 and bent tip 53-2 form a fourth bend 55-4 at the junction thereof. Fourth bend 55-4 has an angle of approximately 80 degrees. Fourth bend 55-4 ensures that there is sufficient contact air gap between contact 47-1 and the rotatable contact (to be hereinafter described in detail) when the rotatable contact is rotated.

Figure 2:
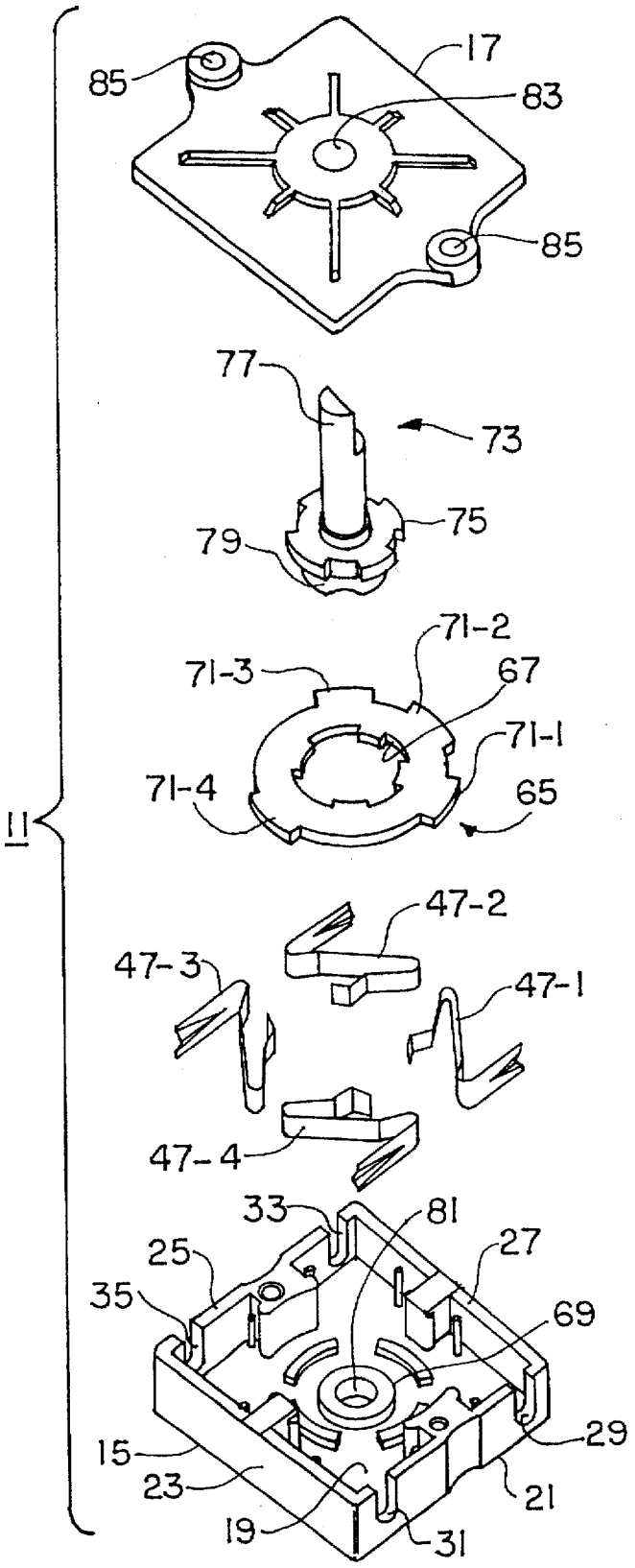
FIG. 2 is an exploded perspective view of the rotary electrical switch shown in FIG. 1.
Figure 5:
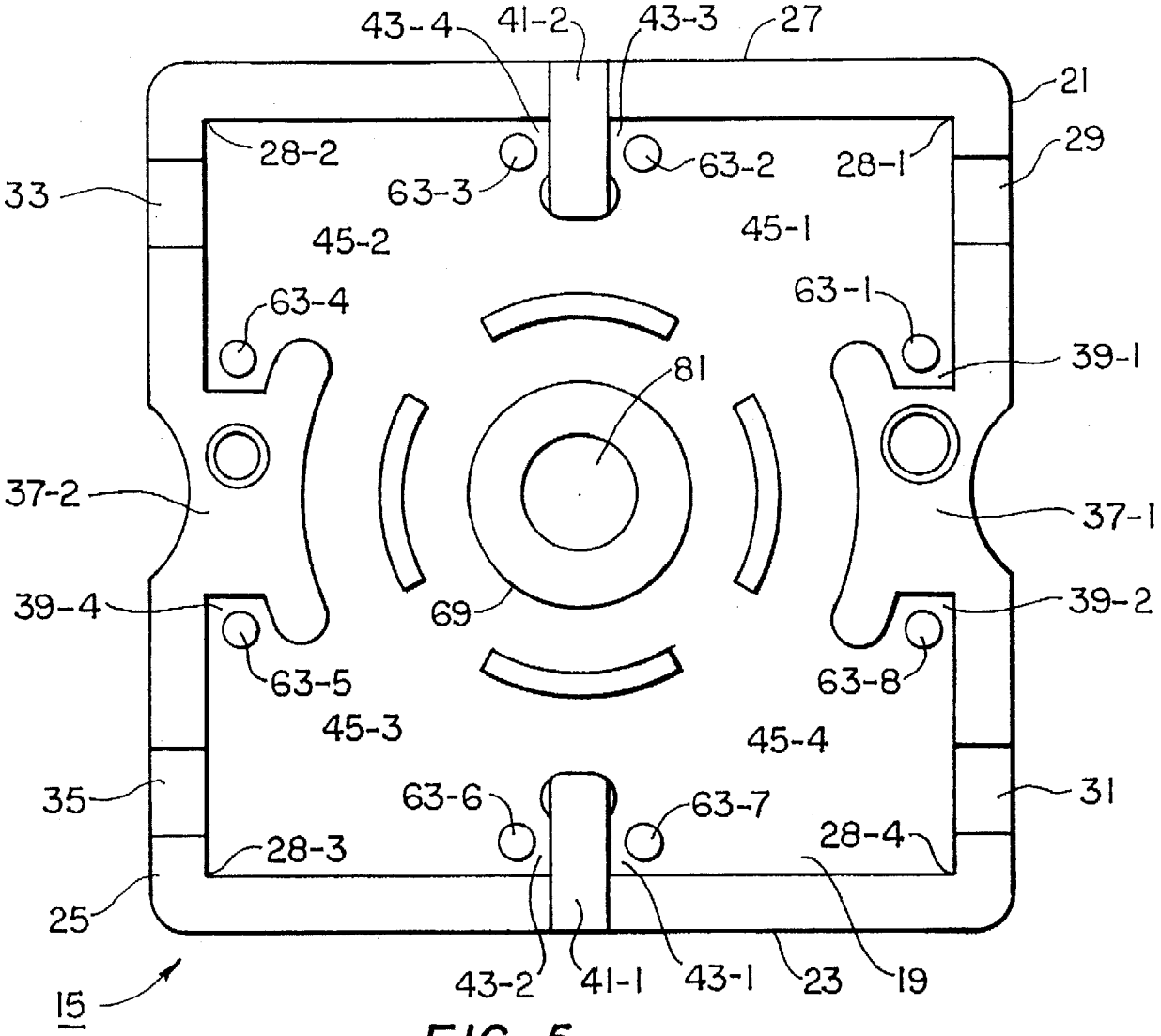
FIG. 5 is an enlarged top plan view of the base shown in FIG. 2.

Referring now to FIG. 2, switch 11 further comprises a rotatable contactor 65 constructed of a conductive material such as brass. Rotatable contactor 65 is generally annular shaped and flat and comprises a central opening 67. Opening 67 is of a size to fit over an annular boss 69 on bottom wall 19 of base 15. In addition, there are four contact projections 71-1 through 71-4 integrally formed onto contactor 65. Projections 71 serve the purpose of making or breaking a connection with spring fingers 53 of stationary contacts 47 to form a closed or open circuit, respectively. The peripheral edge of projections 71 includes a detent notch which is engageable with bent tip 53-2 of contact 47 to hold the connection in place.

Switch 11 further comprises a switch handle 73 constructed out of a material such as plastic. Switch handle 73 comprises a cam portion 75 and a shaft 77. Cam portion 75 is engageable with rotatable contactor 65 and includes detent notches on its periphery which, along with projections 71, are engageable with bent tip 53-2 of contacts 47 in order to lock the position of switch handle 73 in place. Cam portion 75 includes a cylindrical projection 79 which is pivotally mountable into a bore 81 located in the center of annular boss 69. Rotatable contactor 65 and switch handle 73 are held in switch 11 by cover member 17, with shaft 77 extending through a central opening 83 in cover member 17.

Cover member 17 of housing 13 includes a pair of mounting holes 85 located in bosses 14-1 and 14-2. Mounting holes 85 enable switch 11 to be mounted onto a wall or similar portion of a device with which the switch 11 is to be used, such as by a screw and washer (not shown).

Cover member 17 also includes a plurality of stiffening ribs 87 which prevent cover 17 from distorting in use. Cover member 17 further comprises energy directors 89 and 91, i.e. elongated projections, on its inside surface. In the process of ultrasonically welding cover member 17 to recessed base 15, energy directors 89 and 91 melt into a liquid and flow so as to permanently bond cover 17 and base 15 together as a one piece molding with no air gaps. Also, because energy directors 89 and 91 are positioned onto first and second partitions 37 and 41, fixed contacts 47 are more effectively isolated, thereby limiting the electrical dangers which may occur when two conductive pieces of material approach one another.

As can be seen in FIG. 6, there are shown a plurality of arcuate projections 93 integrally formed on the bottom wall of recessed base 15. Arcuate projections 93 serve the function of pushing rotatable contactor 65 up onto engagement with cam portion 75 of switch handle 73. Arcuate projections 93 therefore prevent rotatable contactor 65 from falling down off of cam portion 75 of handle 73 as a result of heat or shock within switch 11.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A rotary electric switch comprising:

a. a housing having a plurality of wire receiving openings;

b. a plurality of stationary contacts positioned within said housing, each stationary contact comprising a locking tongue, a spring finger and an intermediate arm, the intermediate arm linking the locking tongue to the spring finger, the locking tongue being connected to the intermediate arm at a first bend and the intermediate arm being connected to the spring finger at a second bend, each stationary contact being positioned in said housing so that its locking tongue overlies at least a portion of one of said wire receiving openings for locking engagement with a wire to be inserted therethrough;

c. said housing being configured to include a plurality of pairs of posts, one pair of posts for each stationary contact, one post of each pair being located within the first bend of each stationary contact and the other post of each pair being located within the second bend of each stationary contact, said posts serving to hold said stationary contacts in place in the housing; and d. a rotatable contactor mounted inside said housing for selectively contacting said stationary contacts.

2. The rotary electric switch as claimed in claim 1 wherein said housing is configured to include a plurality of pairs of corners, one of said posts being proximate but spaced away from each corner so as to sandwich the first and second bends of each stationary contact within an associated corner and thereby prevent any shifting of the stationary contacts during use.

3. The rotary electric switch as claimed in claim 2 wherein said stationary contacts are generally Z-shaped.

4. The rotary electric switch as claimed in claim 3 wherein the each stationary contact further includes a third bend in the intermediate arm, the third bend having an angle of about 130 degrees to 140 degrees.

5. The rotary electric switch as claimed in claim 4 wherein the spring finger of each stationary contact comprises a straight member and a bent tip, the straight member and the bent tip forming a bend angle at the junction thereof of about 80 degrees.

6. The rotary electric switch as claimed in claim 5 wherein said housing is about 1 inch in length, 1 inch in width and 0.2 inches in thickness.

7. The rotary electric switch as claimed in claim 6 further comprising a handle assembly for rotating said rotatable electrically conductive contactor.

8. The rotary electric switch as claimed in claim 7 wherein there are four stationary contacts and the housing is rectangular.

9. The rotary electric switch as claimed in claim 8 wherein said housing comprises a cover and a base, the cover including at least one stiffening rib on its outer surface to prevent distortion.

10. The rotary electric switch as claimed in claim 9 wherein the cover of said housing comprises a pair of mounting holes for use in attaching said switch to a mount structure.

11. The rotary electric switch as claimed in claim 10 wherein the base in said housing comprises a plurality of arcuate projections positioned directly underneath said rotatable contactor.

12. The rotary switch as claimed in claim 11 wherein said housing comprises a plurality of energy directors which enable for the permanent welding of the base to the cover ultrasonically.

13. The rotary switch as claimed in claim 12 wherein each stationary contact is a unitary structure.

14. A rotary electric switch comprising:

a. a housing having a wire receiving opening;

b. a stationary contact positioned within said housing, said stationary contact comprising a locking tongue, a spring finger and an intermediate arm, the intermediate arm linking the locking tongue to the spring finger, the locking tongue being connected to the intermediate arm at a first bend and the intermediate arm being connected to the spring finger at a second bend, said stationary contact being positioned in said housing so that its locking tongue overlies at least a portion of said wire receiving opening for locking engagement with a wire to be inserted therethrough;

c. said housing being configured to include a pair of posts, one post being located within the first bend of said stationary contact and the other post being located within the second bend of said stationary contact, said posts serving to hold said stationary contact in place in the housing; and d. a rotatable contactor mounted inside said housing for selectively contacting said stationary contact.

15. The rotary electric switch as claimed in claim 14 wherein said housing is configured to include a pair of corners, one of said pair of posts being proximate but spaced away from each corner so as to sandwich the first and second bends of said stationary contact within its associated corner and thereby prevent any shifting of said stationary contact during use.

16. The rotary electric switch as claimed in claim 15 wherein one of said two posts for said stationary contact is positioned within the first bend of said stationary contact and the other of said two posts is positioned within the second bend of said stationary contact.

17. The rotary electric switch as claimed in claim 16 wherein said stationary contact is generally Z-shaped.

18. The rotary electric switch as claimed in claim 17 wherein said stationary contact further includes a third bend in the intermediate arm, the third bend having an angle of 130 degrees to 140 degrees.

19. The rotary electric switch as claimed in claim 18 wherein the spring finger of said stationary contact comprises a straight member and a rounded tip, the straight member and the rounded tip forming a bend angle at the junction thereof of approximately 80 degrees.

20. The rotary electric switch as claimed in claim 19 wherein said housing is about 1 inch in length, 1 inch in width and 0.2 inches in thickness.

21. The rotary electric switch as claimed in claim 1 wherein said first bend in each stationary contact extends around one of said posts and said second bend in each stationary contact extends around another one of said posts.

22. The rotary electric switch as claimed in claim 21 wherein said housing includes a base having a plurality of sidewalls and a plurality of partitions, one partition extending inward from each sidewall.

* * * * *